US005375547A

United States Patent [19]

Abe et al.

[11] Patent Number: 5,375,547

[45] Date of Patent: Dec. 27, 1994

[54] SELF-STANDING LIQUEFIED GAS STORAGE TANK AND LIQUEFIED GAS CARRIER SHIP THEREFOR

[75] Inventors: Akinori Abe, Yokohama; Akitoshi Ando, Kamifukuoka, both of Japan

[73] Assignee: Ishikawajima-Harima Heavy Industries Co., Ltd., Japan

[21] Appl. No.: 174,892

[22] Filed: Dec. 27, 1993

[30] Foreign Application Priority Data

| | | | |
|---|---|---|---|
| Apr. 9, 1993 | [JP] | Japan | 5-108916 |
| May 27, 1993 | [JP] | Japan | 5-126371 |
| May 27, 1993 | [JP] | Japan | 5-126375 |

[51] Int. Cl.[5] ..... B63B 25/08

[52] U.S. Cl. ..... 114/74 A; 220/901

[58] Field of Search ..... 114/72, 73, 74 R, 74 A, 114/74 T; 220/901

[56] References Cited

U.S. PATENT DOCUMENTS

| | | | |
|---|---|---|---|
| 3,566,824 | 3/1971 | Cuneo | 114/74 A |
| 3,583,351 | 6/1971 | Gorman | 114/74 A |
| 3,612,333 | 10/1971 | Cowles | 114/74 A |
| 3,724,411 | 4/1973 | Alleaume | 114/74 A |

FOREIGN PATENT DOCUMENTS

| | | |
|---|---|---|
| 2249796 | 3/1989 | Japan . |
| 0048999 | 4/1990 | Japan . |
| 0492794 | 8/1990 | Japan . |

*Primary Examiner*—Stephen P. Avila

*Attorney, Agent, or Firm*—Pearne, Gordon, McCoy & Granger

[57] ABSTRACT

A rectangular-shaped self-standing liquefied gas storage tank carried in a low temperature liquefied gas carrier ship is disclosed. The tank is of an approximate box-shape having a bottom plate section, front and rear sections, two side wall sections, and a roof plate section. The carrier ship has bulkheads inside thereof, formed along the direction of the width of the carrier ship, to define holds for each of the tanks. The tank has reducing sections between the roof plate section and the lateral wall sections, which are directed toward the inner side of the tank and extend upwardly. Lateral movement restraining members are provided between the front wall section of the tank and one of the bulkheads of the carrier ship, and between the rear wall section of the tank and another bulkhead.

11 Claims, 13 Drawing Sheets

SELF-STANDING LIQUEFIED GAS STORAGE TANK AND LIQUEFIED GAS CARRIER SHIP THEREFOR

BACKGROUND ART

The present invention relates to improvements of a self-standing liquefied gas storage tank for a low temperature liquefied gas carrier ship which transports low temperature liquefied gas such as liquefied natural gas (LNG) and liquefied petroleum gas (LPG) or the like, and of a liquefied gas carrier ship having these tanks;.

Various types of low temperature liquefied gas carrier ships which transport low temperature liquefied gas such as LNG or LPG have been used. Some of these use self-standing liquefied gas storage tanks for transporting low temperature liquefied gas, and examples of these carriers are disclosed in Japanese Patent Application, First Publication No. 2-249796, Japanese Patent Aplication, First Publication No. 4-8999, and Japanese Patent Application, First Publication No. 4-92794.

An example of this carrier ship is shown in FIG. 12. This liquefied gas carrier ship may be easily have a flat deck 5 and makes it possible to increase the storage capacity of the liquid by forming liquefied gas storage tanks 4 carried in a ship's hull 1 into rectangular shades. Furthermore, it is contemplated, as shown in FIG. 13, to adopt a double casing structure (armored-structure) having an outer shell 1A and an inner shell 1B in the ship's hull 1 in order to ensure safety.

For such a low temperature liquefied gas carrier ship having rectangular-shaDed self-standing tanks, it is contemplated, as shown in an example in cross-sectional view in FIGS. 13 and 14, to mount the rectangular-shaped tank 4 to a ship's bottom 2 of the ship's hull 1, in a self-standing state, by a plurality of supporting devices 3. The tank 4 is constructed of alloy sheets such as aluminum alloy sheets. In FIG. 14, chain lines show that the tank 4 may contract, as indicated by continuous lines, when the tank 4 is filled with low temperature liquefied gas, and thus, the supporting devices 3 allow the contraction of the tank 4.

The portion above the tank 4 is covered by a deck 5, and the tank 4 is prevented from moving laterally by stops 6 provided between an under surface of the deck 5 and an upper surface of the tank 4.

However, the above structure requires the depth D of the ship's hull 1 to be increased, and this causes the weight of the ship and the amount of labor required to build the ship to increase. Furthermore, it is necessary to reinforce the deck 5 in order to restrain the lateral movement of the rectangular-shaped self-standing tanks 4. Additionally, since the upper surface of the ship's hull 1 is constituted by a single unitary integrated deck 5, stress in the deck 5 arising from the bending moment imparted by wave action is great. In this respect, the above structure again causes an increase in the weight of the ship and the amount of labor required.

An inner surface of a tank wall 7 of the rectangular-shaped self-standing tank 4 is provided with n%ain frames 8 and reinforcing plates 9 as stiffeners, as shown in FIGS. 13 and 15. The main frames 8 and the reinforcing plates 9 protrude from the inner surface of the tank wall 7 and are mutually transverse so that the entire tank can be made rigid. As shown in FIG. 15, each of the supporting devices 3 is located at positions corresponding to both the main frame 8 and the reinforcing plates 9. When the supporting device 3 is bearing the load of the tank 4, stress in the weld (fillet weld) portion between the inner surface of the tank wall 7 and the reinforcing plate 9 may increase.

As shown in FIG. 16, in between two adjacent reinforcing plates 9, a carling 11 is welded at. fillet weld portions 12 at a right angle to the plates 9 in order to reinforce the reinforcing plates 9 and fillet weld portions 10 thereof.

Although a decrease in the occurrence of stress near the fillet weld portions 10 may be anticipated by means of the carling 11, adequate examinations for stress in portions near the boundary section between a side surface of the reinforcing plate 9 and the upper end surface of the carling 11 are required.

if there is a gap G between the upper end surface of the carling 11 and a reinforcing face bar 9a, a welding torch can be inserted in the gap G, and this makes it possible to weld the portion 12 by boxing (box welding) so as to improve the strength of the reinforcing plate 9 and the fillet weld portions 10.

If the upper end surface of the carling 11 is directly welded to the lower face of the reinforcing face bar 9a, stress in the reinforcing plate 9 and the fillet weld portions 10 may be reduced. However, this structure makes it impossible to carry out the boxing (box welding), and thus reduces fatigue resistance.

Typically, a liquid storage tank or a shell of such a iquid carrier ship has a structuze in which a plurality of metal plates are transversely combined.

FIGS. 17–19 show reinforced structural bodies A, B, and C respectively which are conventionally used in such tanks, shells, or the like.

Referring to FIG. 17, the reinforced structural body A comprises a tank wall 7 of a bulkhead and a reinforcing member 14. The tank wall 7 is constituted by an integrated plate in which a plurality of plates are welded at butt weld joint portion 13. The reinforcing member 14 is welded on a surface of the tank wall 7 by fillet welding 15 transversely to the butt weld joint portion 13. A cut-out port 16 is formed on the reinforcing meraber 14 so as to prevent the butt weld joint portion 13 and the fillet weld portions 15 from interfering with each other. A li,zruid passing port 17 is also provided on the reinforcing member 14.

In the reinforced structural body B, as shown in FIG. 18, a reinforcing member 14 is welded on a surface of the tank wall 7 by fillet weld 15. Furthermore, a transverse reinforcing plate 18 is provided by fillet weld 19, in a standing state, on the same surface of the tank wall 7, transversely with respect to the reinforcing member 14. The transverse reinforcing plate 1St has a cut-out port 16 through which the reinforcing member 14 passes, and a tongue portion 18a protruding into the cut-out port 16. The protruding end of the tongue portion 18a is welded to one side of the reinforcing member 14 by fillet welding 20. In this case, the area adjacent to the fillet weld portions 15 is reinforced by the tongue portion 18a. The cut-out mort 16 doubles as a liquid passing port 17, and prevents the fillet weld portions 15, 19, and 20 from interfering with one another.

In the reinforced structural body B, as shown in FIG. 19, reinforcing members 14A, 14B, and 14C, which are parallel to one another, are welded to on a surface of the tank wall 7 by fillet weld portions 15, and ribs 21 are provided in between two of the adjacent reinforcing members. These ribs 21 are welded to both the tank wall 7 and the reinforcing members by fillet weld portions 22, 23, and 24. Cut-out ports 16 double as liquid passing ports 17, and prevent the fillet weld portions 15, 22, 23, and 24 from interfering with one another.

However, in the above-mentioned reinforced structures A, B, and C as shown in FIGS. 17–19, the fillet weld portions 19, 20, 22, 23, and 24 are discontinuous at the cut-out ports 16, and this obstructs a continuous weld. Thus this reduces the welding workability, or makes it difficult to use an automatic welding machine. Furthermore, the discontinuity of the welded portion causes stress concentration thereat, and leads to occurrences of imperfections, and therefore to a deterioration of welding quality an.d reliability.

SUMMARY OF THE INVENTION

The present invention was developed in view of the above situation. It is an object thereof to provide a rectangular-shaped self-standing tank which can lighten a ship's hull structure, and to provide a low temperature liquified gas carrier ship having the rectangular-shaped self-standing tanks.

Another object of the present invention is to improve the welding workability for the portions supporting the tank weight while ensuring the strength of these portions.

Another object of the present invention is to make it possible to carry out a continuous weld on a tank or a shell so as to simplify the weld structure and to improve the reliability of the structural integrity of the tank.

In order to accomplish these objects, the present invention provides:

a rectangular-shaped self-standing liquefied gas storage tank for storing low temperature liquefied gas therein, a plurality of the storage tanks arranged in a low temperature liquefied gas carrier ship along the longitudinal direction of the carrier ship, the low temperature liquefied gas carrier ship having a plurality of bulkheads extending widthwise with respect to the carrier ship to define a hold for housing said liquefied gas storage tanks, the self-standing liquefied gas storage tank comprising:

a bottom plate section having an approximately rectangular shape;

front and rear wall sections facing each other, rising approximately perpendicularly from the bottom plate portions, and extending widthwise with respect to the carrier ship;

a pair of side wall sections facing each other, rising approximately perpendicularly from the bottom plate section and extending longitudinally with respect to the carrier ship;

a roof plate section facing the bottom plate section;

a pair of reducing sections, each formed between the roof plate section and each of the side wall section, and directed toward the inside of the tank as the reducing sections extend upwardly so that the sectional area of the roof plate section is smaller than that of the bottom plate section; and at least one lateral movement restraining means for preventing the liquefied gas storage tank from moving laterally, provided between the front wall section of the tank and one of the bulkheads facing the front wall section, and between the rear wall section of the tank and one of the bulkheads facing said the wall section.

In order to accomplish the above objects, the present invention further provides:

a liquefied gas carrier ship having rectangular-shaped self-standing liquefied gas storage tanks, the liquefied gas carrier ship comprising:

a shell;

holds, each formed in the shell to accommodate each of the rectangular-shaped self-standing liquefied gas storage tanks;

decks provided on the shell;

wherein, the shell is formed of a shallow construction in which an upper end of the shell terminates before the reducing section of the tank, and the decks being formed so as to cover each of the holds respectively.

According to the rectangular-shaped self-standing liquified gas storage tank for a low temperature liquid gas carrier ship of the present invention, the tank is formed such that the upper part thereof is reduced by cutting off the upper corner portion thereof. Furthermore, the lateral movement of the tank is restrained by the stopping blocks (lateral movement restraining means) provided between the front wall section of the tank and the bulkhead facing the front wall section, and between the rear wall section of the tank and the bulkhead facing the rear wall section. As a result of this, there is no need to provide any movement restraining means at the upper pornion of the tank, and the supporting structure for the tank can therefore be simplified.

Furthermore, the curved surface formed on the carling can reduce the stress occurring in the portion adjacent to the portion connected to the reinforcing plate, resulting in reduction of the stress distribution under a loaded situation. Moreover, boxing (box welding) can be carried out since the inner end surface of the carling terminates before the reinforcing face bar, so that welding workability can be ensured.

Additionally, according to the present invention, when a reinforcing member is welded to a tank wall (or a bulkhead) having a butt weld joint portion, the surface of the butt weld joint portion to be welded to the reinforcing member is made flush by grinding an area larier than that at which the reinforcing member is to make contact. In this situation, the reinforcing member is placed on the surface of the tank wall, and then the corner portions formed between the tank wall and the reinforcing member will be continuously welded by fillet welding.

In the case in which a transverse reinforcing plate is provided transversely to the reinforcing member, the plate and the menlber are joined such that the reinforcing member passes through the plate. In this situation, the corner portions formed by the tank wall, the reinforcing member, and the transverse reinforcing plate are continuously welded in an L-shape by fillet welding.

In the case in which a rib is provided between two reinforcing members, the corner portions formed by the tank wall, the reinforcing members, and the rib are continuously welded by fillet welding.

Furthermore, according to the low temperature liquified gas carrier ship in accordance with a second aspect of the present invention, the ship's hull structure is made shallow, using the tank in accordance with the first aspect of the present invention in which the upper corners thereof are cut off, so that both the ship's port wall and the starboard wall terminate before the reducing sections of the tank, and each tank is covered with independent decks, respectively. As a result of this, the structure of the ship's hull and the deck is simplified, and thus, the ship's weight can be reduced.

DESCRIPTION OF THE PREFERRED EMBODIMENTS

Figure 1:
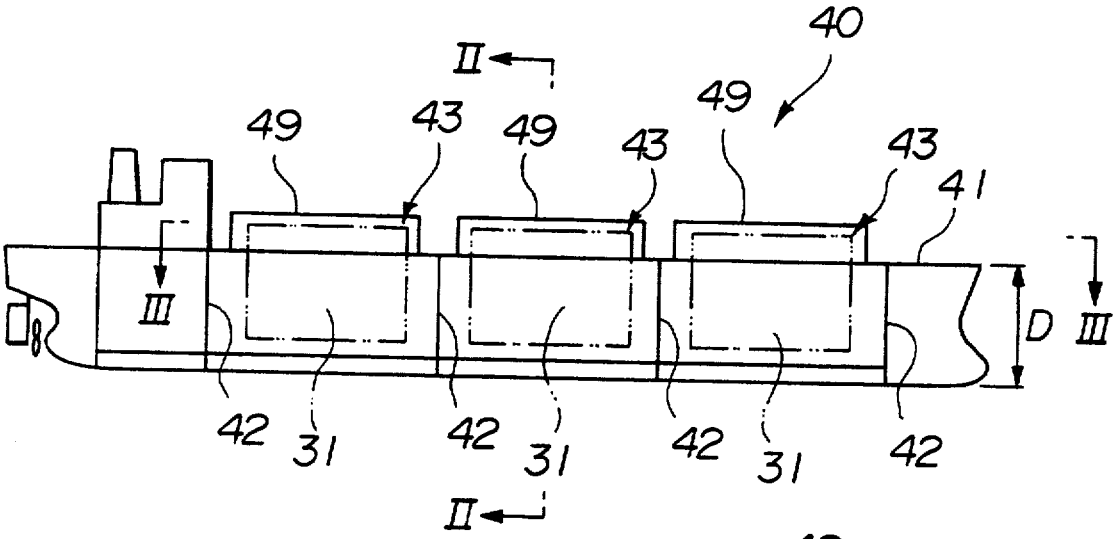
FIG. 1 is a general side view of a low temperature liquified gas carrier ship having rectangular-shaped self-standing tanks in accordance with the present invention.

Referring to the drawings, FIGS. 1 to 4 relate to the first eDodiment of a rectangular-shaped self-standing liquified gas storage tank and to a low temperature liquified gas carrier ship having these tanks in accordance with the present invention.

As shown in FIG. 1, a low tem]Derature liquified gas carrier ship 40 has rectangular-shaped self-standing tanks 31 in a ship's hull 41.

Figure 2:
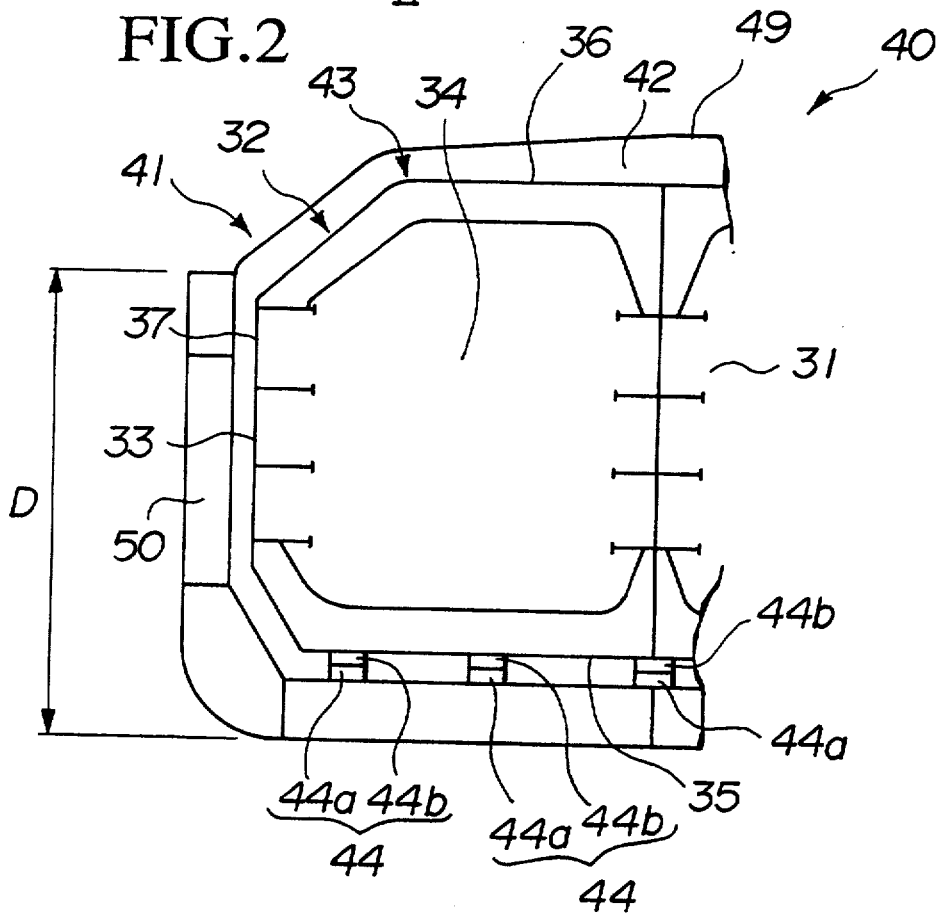
FIG. 2 is a partial sectional view taken along line II—II in FIG. 1.

As shown in FIG. 2, each of the tanks 31 is constituted by a tank shell 37 and has an approximately box shape. The tank shell 37 comprises a bottom plate section 35 having an approximately rectangular shape; front and rear wall sections 34 facing each other, rising approximately perpendicularly from-the bottom plate portion 35, and extending widthwise with respect to the ship's hull 41; a pair of side wall sections 33 facing each other, rising approximately perpendicularly from the bottom plate portions 35, and extending longitudinally with respect to the ship's hull 41; and roof plate section 36 facing the bottom plate portion 35. The roof place section 36 and each one of the side wall sections 33 continue at a reducing section 32 which is directed toward the inside of the tank and extends upwardly, so that the sectional area of the roof plate section 36 is smaller than that of the bottom plate section 35. Thus, the zank is so configured that the lateral upper corners are cut off. The bottom plate section 35, the side wall sections 33, and the front and rear wall sections 34 of the tank shell 37 are formed according to the configuration of holds of the ship's hull 41 in which the tanks 31 are installed.

The supporting structure for the tanks 31 will be explained below together with an explanation of the structure of the carrier ship 40.

The low temperature liquified gas carrier ship 40 has a plurality of holds 43 divided by bulkheads 42 extending widthwise with respect to the armored-type ship's hull 41. Supporting blocks 44a, each having a sliding face on its upper face, are arranged on a bottom plate of each of the holds 43. Insulating blocks 44b, mounted on the bottom plate section 35 of the tank 31 and formed of plywood and the like, are placed on each sliding face of the supporting block 44a. The supporting block 44a and the insulting block 44b constitute support men,hers for the tank 31.

Figure 3:
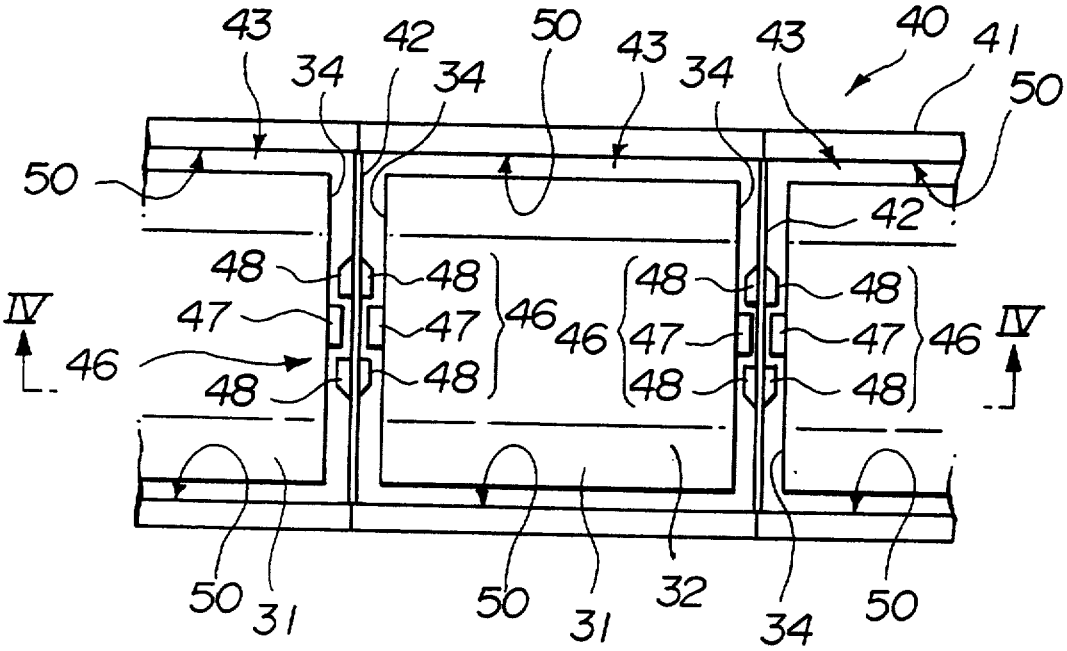
FIG. 3 is a partial sectional view taken along line III—III in FIG. 1.
Figure 4:
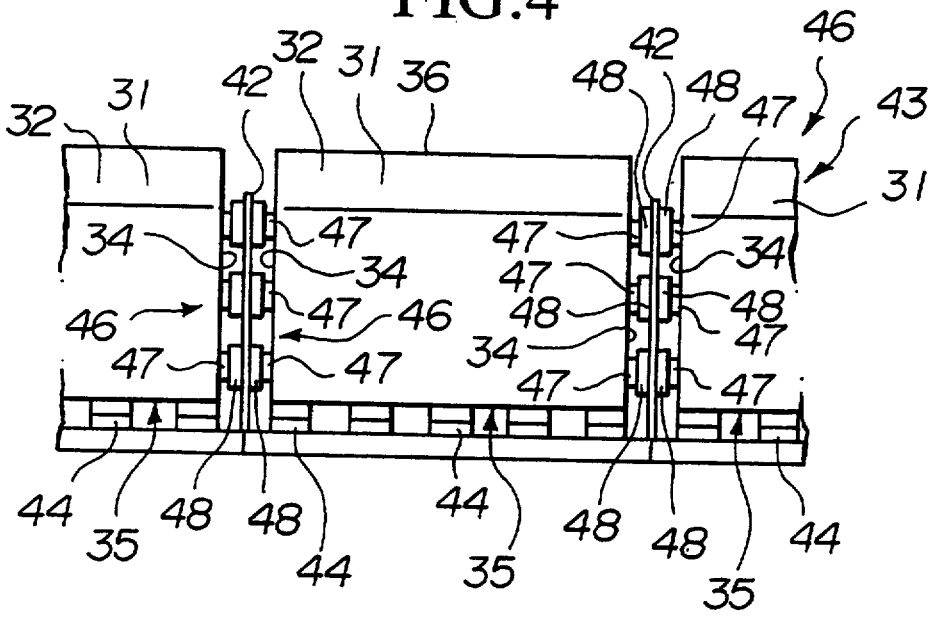
FIG. 4 is a partial sectional view taken along line IV—IV in FIG. 3.

On the other hand, there is no support means or restraining means on the top of the tank 31. As shown in FIGS. 3 and 4, lateral movement restraining means 46 is provided between the front wall section 34 of the tank 31 and a bulkhead 42 facing to the front wall section, and between the rear wall section 34 of the tank 31 and a bulkhead 42 facing to the rear wall section. That is, lateral movement of the tank 31 is restrained by the wall sections. Each of the lateral movement restraining means 46 comprises a heat insulating block 47 provided on the front or rear wall sections 34 of the tank 31, and a pair of stopping blocks 48 provided on the front or rear bulkhead of the ship's hull 41 so as to be located at both sides of the block 47.

By adopting the aforementioned lateral movement restraining structure, there is no need to construct a ship's hull structure to support a great force at the top of the tank 31. If it is required to provide an antiflotation means to prevent the floating of the tank 31 during accidental flooding of the hold, such antiflotation means can be provided between the front wall section 34 and the bulkhead 42 facing the front wall section and between the rear wall section 34 and the bulkhead 42 facing the rear wall section, or alternatively, between the side wall sections 33 of the tank 31 and the side walls of the hold 43, and thus, there is again no need to arrange any kind of restraining means at the top portion of the tank 31.

Since the low temperature liquified gas carrier ship 40 having the tanks 31 has the aforementioned lateral movement restraining structure, the upper end of the ship's hull 41 in the direction of the depth D terminates before the reducing section 32 of the tank 31, as shown in FIGS. 1 and 2. The depth D of the ship's hull is determined in accordance with required buoyancy of the carrier sFip 40 and the necessity for safe operations, or the like.

The reason the ship's hull depth D can be reduced is that there is no need to support the tank 31 at its top portion, and therefore, there is no need to surround the tanks 31 by rigid structures similar to the main structure for the ship's hull. Therefore, it is not necessary for the deck 49 to support great forces, and thus, the ship's hull can be more lightly built.

Accordingly, in the present invention, the deck 49 is formed in an arch shape laid across; the ship's hull 41 widthwise, and is divided in the longitudinal direction of the ship's hull for each of the ship's holds 43. Based on this structure, the deck 49 has a light-weight structure in which the degree of protection is sufficient to prevent waves and rain from leaking into the tank 31.

As explained above, since the rectangular-shaped selfstanding type tank 31 is formed such that the upper corners thereof are cut off, and since the lateral movement restraining means 46 are provided on the front and rear wall sections 34 of the tank, the tank 31 can make it possible to rationalize the structure of the carrier ship having the tank, reduce the depth D of the ship's hull 41, and lighten the structure of the deck.

Furthermore, by the aforementioned carrier ship 40, since the depth D of the ship's hull 41 can be reduced, the amount of steel used for constructing the ship's hull 41 and the amount of labor required for producing the ship's hull can be reduced.

Furthermore, since the weight of ship's hull 41 is reduced, the speed of the ship can be increased, and the sizes of mooring equipment such as anchors or chains and the like can be reduced.

The amount of steel used for the deck and the amount of labor for producing the deck can also be reduced, since the deck 49 can be constructed as a lighter structure.

Moreover, the construction of the decks 49 is facilitated after setting up the tanks 31 in the holds 43, and this makes it possible to reduce the amount of labor for producing the decks 49.

Additionally, since each deck 49 is in spaced relation to the others, corresponding to each hold 43, stress caused by the vertical bending moment of the ship's hull cannot be transferred to the decks 49. Moreover, since the deck 49 has an arch shape, sufficient strength to support the loads of waves or rain can be obtained with a light construction.

The above-mentioned low temperature liquified gas carrier ship 40, which has self-standing tanks 31 within the shallow ship's hull 41, may be seen as being similar to MOS spherical carrier ships having spherical tanks. However, the MOS spherical carrier ships have problems such as the diameter of the spherical tank is determined by the ship's hull size, or conversely, a ship's hull size must be determined by the size of the spherical tank. In contrast, the low temperature liquified gas carrier ship 40 in accordance with the present invention using the rectangular-shaped tanks 31 does not have such a problem, so that the tanks can be designed freely according to the shape or the structure of a ship's hull.

Figure 5:
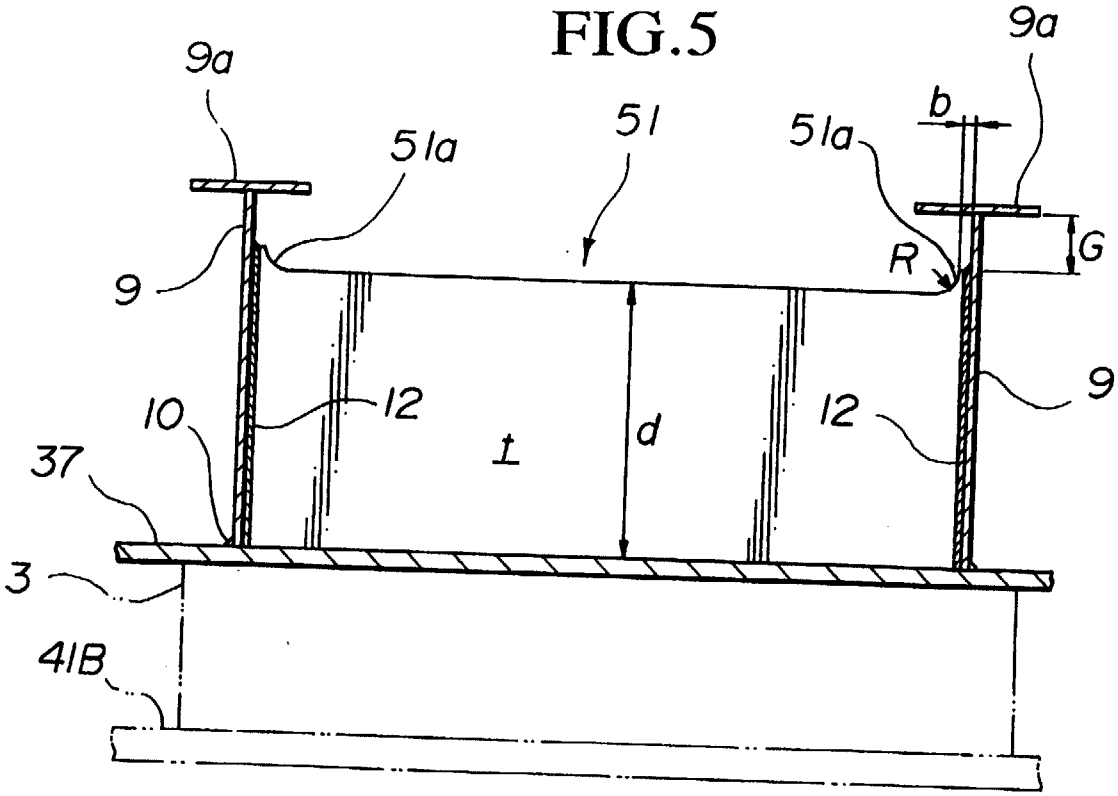
FIG. 5 is a partial sectional view of a reinforced structure of a rectangular-shaped self-standing tank in accordance with the present invention.
Figure 6:
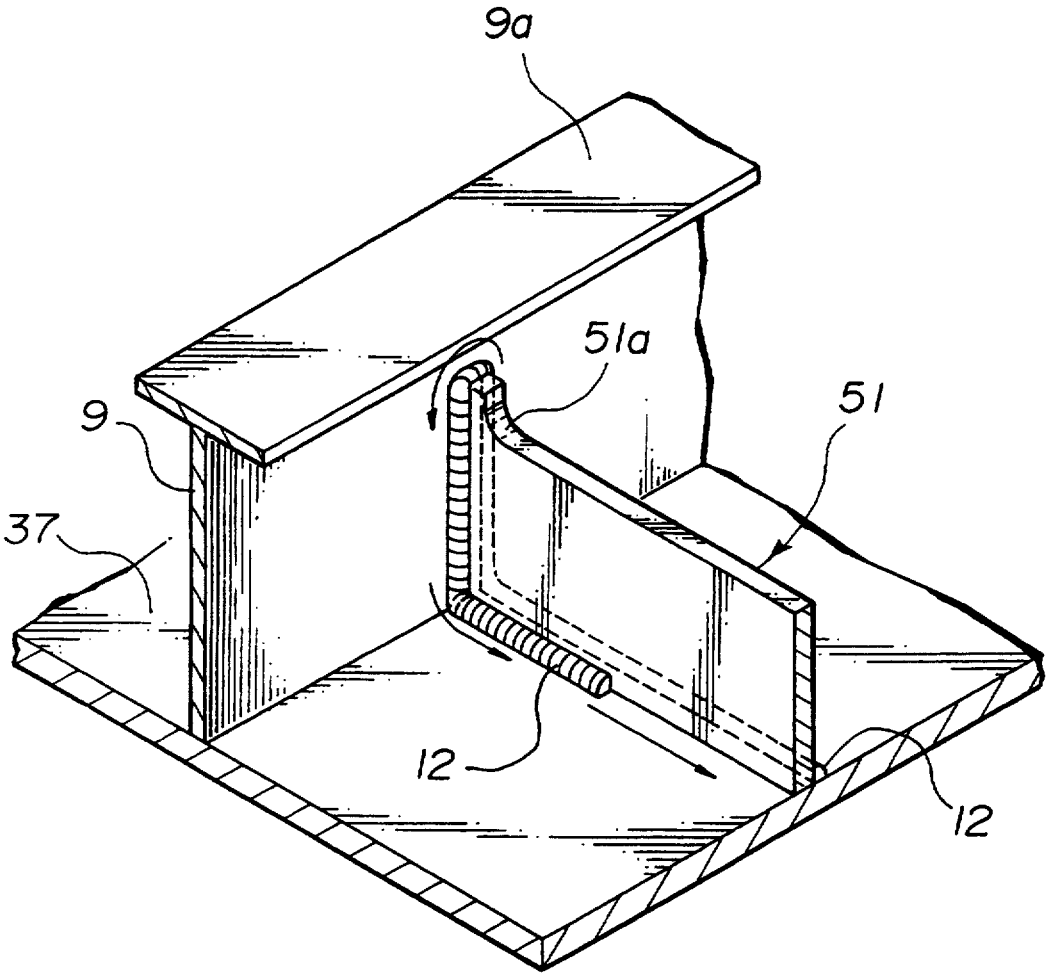
FIG. 6 is a partial perspective view of a reinforced structure of a rectangular-shaped self-standing tank in FIG. 5.
Figure 7:
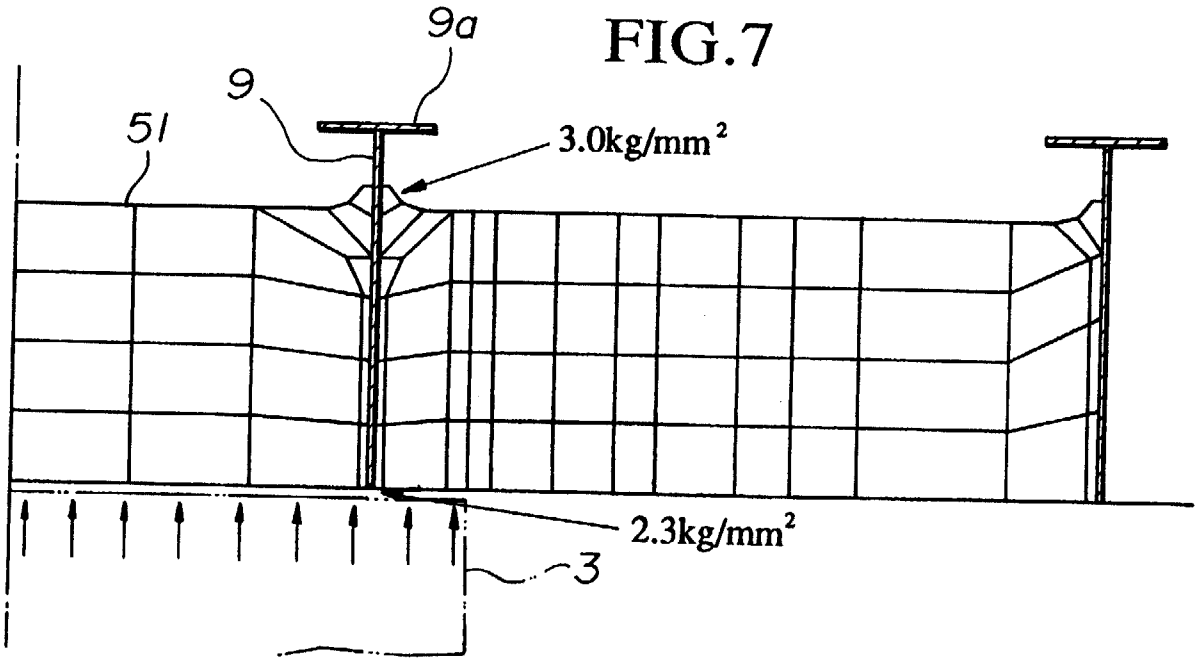
FIG. 7 is a stress analysis map of a carling in a reinforced structure in FIG. 5.

With reference to FIGS. 5 to 7, an embodiment of the reinforced structure of the recmangular-shaped self-standing liquified gas storage in accordance with the present invention will be explained.

Referring to FIGS. 5 and 6, a carling 51 is provided between two of the reinforcing plates 9 facing each other protruding toward the inside of the tank, and is welded thereto at welded portions 12. The carling 51 is provided such that the inner end surface thereof terminates before a reinforcing face plate 9a of the reinforcing plates 9 to define a gap G, and chamfer 51a having curvature R is formed at both sides of the inner end surface which is located adjacent to the welded portion 12. The height d at the central portion of the carling 51 is lowered by the chamfers 51a.

The dimensions of each portion seen in FIG. 5 are, for instance, G: over 40 mm; b: over 15 mm; d: 300 mm; R: over 3 mm; and t: 18 mm.

By providing such reinforced structures with the carling 51, when the carling 51 is welded to the tank shell 37 and the reinforcing plate 9 by fillet welding, boxing (box welding) can be applied to the weld portion 12, as indicated by the arrows in FIG. 6.

Analytical Model

FIG. 7 shows an example of a stress analysis map of the above-mentioned reinforced structure, wherein the supporting device 3 is arranged across two of the of the reinforcing plates 9, and the load of the tank 31 is supported by the supporting device 3, under the conditions that the supporting load for one supporting device 3 is 420,000 kg. The conditions for the analysis were as follows. Material of the tank shell 37: A1-5083; thickness of the tank shell 37: 25 mm; distance between two of the reinforcing plates 9: 900 mm; thickness of the reinforcing plates 9: 12 mm; height of the reinforcing plates: 450 mm; G: 40 mm; b: 15 mm; d: 350 mm; R: 30 mm; and t: 18 mm.

Results

Figure 16:
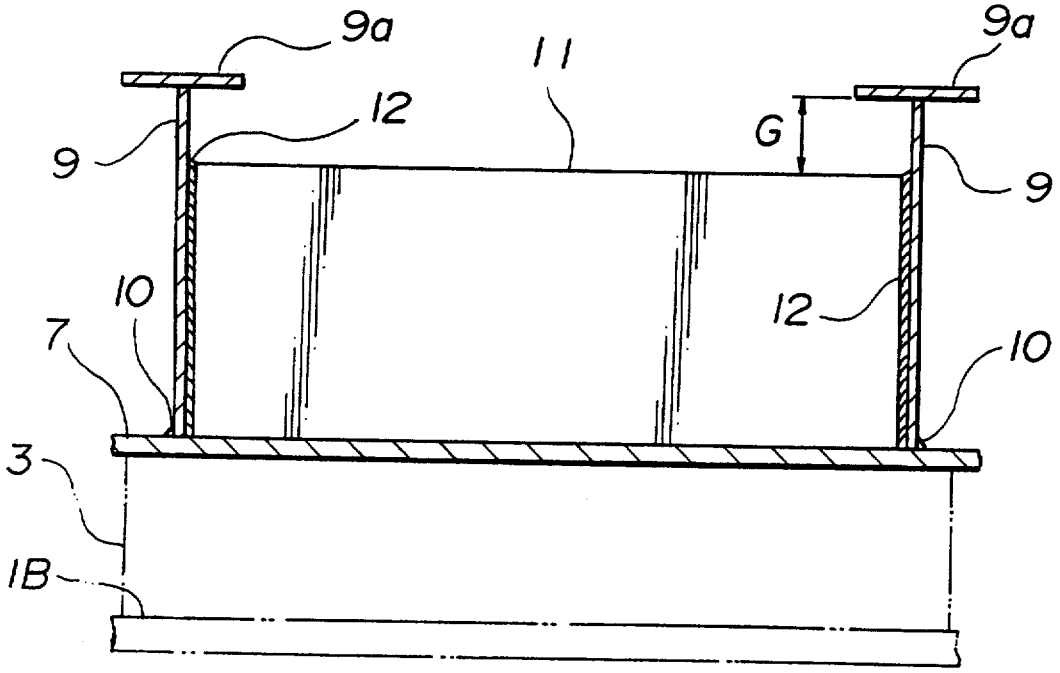
FIG. 16 is a partial sectional view of a reinforced tructure of a rectangular-shaped self-standing tank.

The results of the analysis of the above reinforced structure, compared to that of the structure shown in FIG. 16, are as follows.

Figure 8:
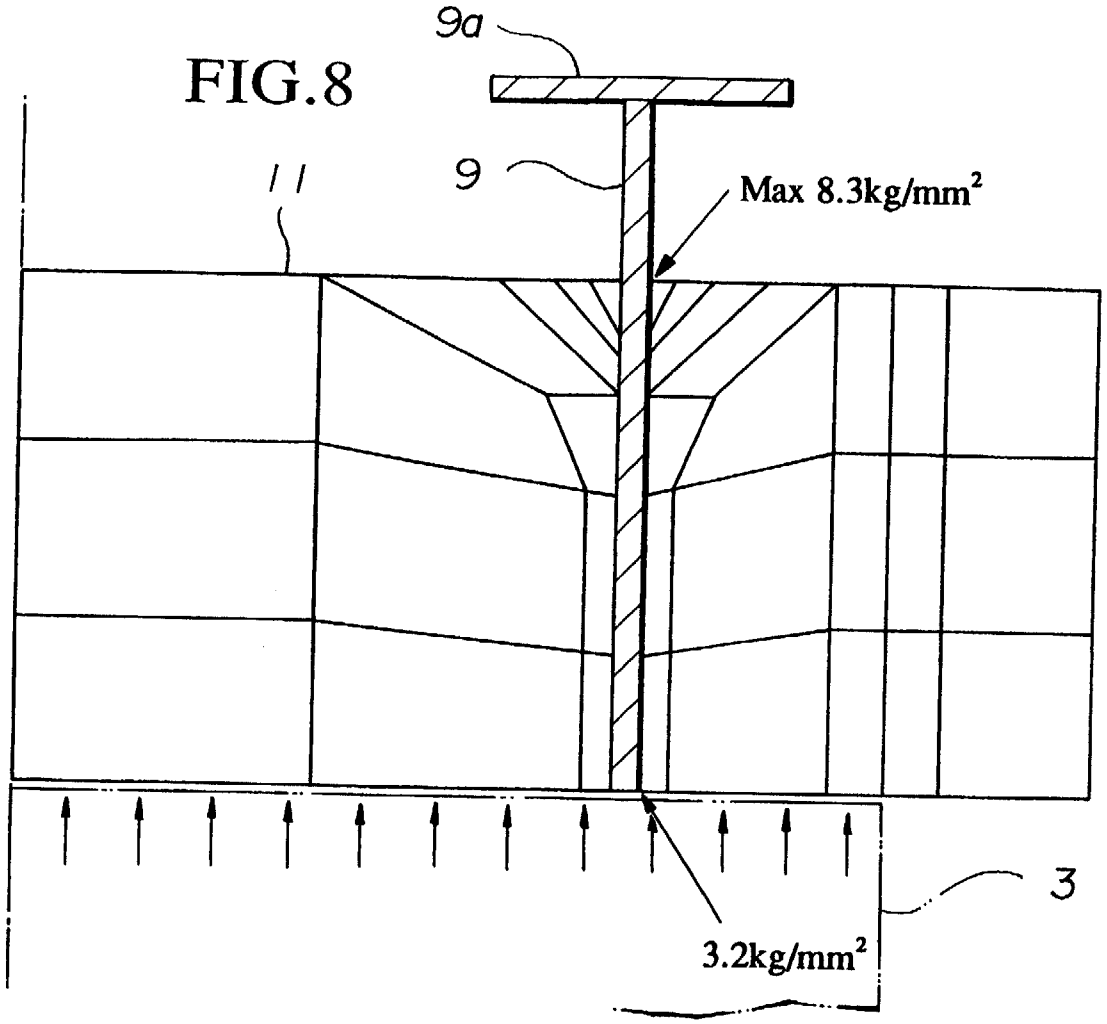
FIG. 8 is a stress analysis map of a carling in a reinforced structure in FIG. 16.

FIG. 8 shows a stress analysis map corresponding to the structure as shown in FIG. 16, analyzed under the same conditions described above. As can be understood from FIG. 8, in the situation in which the supporting force indicated by arrows are loaded onto the structure, when the stress value at the portion adjacent to the fillet weld portion 10 (see, FIG. 16) was 3.2 kg/mm$^2$, the stress value at the boundary portion between the reinforcing plate 9 and the carling 11 was 8.3 kg/mm$^2$ at maximum.

On the other hand, as can be understood from FIG. 7, when the stress value at the portion adjacent to the fillet weld portion 10 was 2.3 kg/mm$^2$, the stress value at the boundary portion between the reinforcing plate 9 and the carling 11 was 3.0 kg/mm$^2$ at maximum. Therefore, it is clear that the reinforced structure in FIG. 7, according to the present invention, has certain advantages over the reinforced structure shown in FIG. 16.

Thus, with regard to the reinforced structure of the rectangular-shaped self-standing liquified gas storage according to the present invention, since the chamfers 51a are ormed on the carlinq 51, the strength of the tank shell of the large loaded portion, especially the portion on which the load is concentrated, can be increased.

Furthermore, since the inner end surface of the carling terminates before the reinforcing face plate due to the predetermined gap G, the application of a welding torch to this portion is facilitated, and the welding workability can be improved.

In the present invention, the following techniques can also be adopted instead of the aforementioned embodiments.

a) The above techniques for self-standing tanks can be applied to other tylDes of carrier ships.

b) The dimension d in FIG. 5 may be reduced to approximately zero.

c) The configuration of the chamfer 51a may be modified.

Next, referring to FIGS. 9 to 11, embodiments of reinforced structural bodies for the shell and the tank according to the present invention will be explained below.

Figure 9:
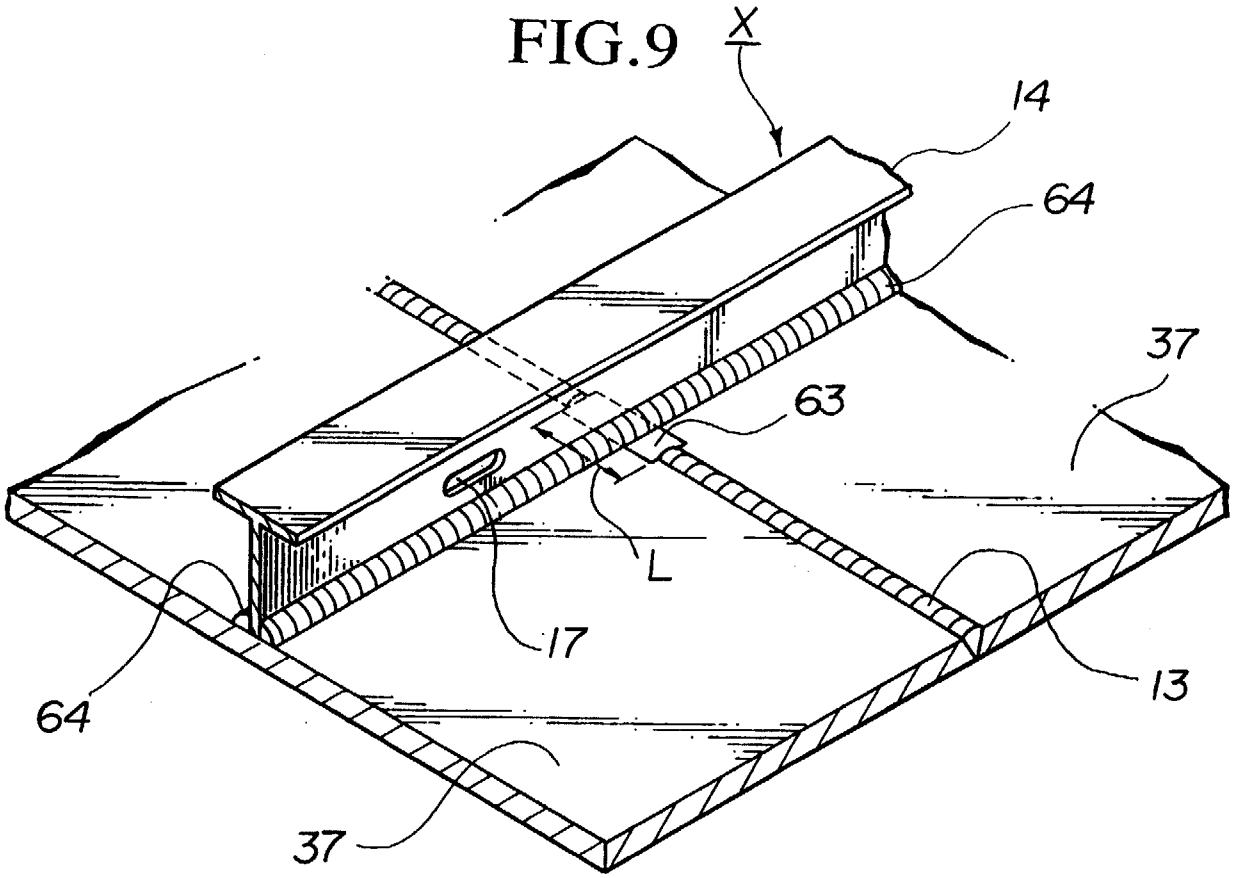
FIG. 9 is a partial perspective view of a welded structure in accordance with the present invention.
Figure 17:
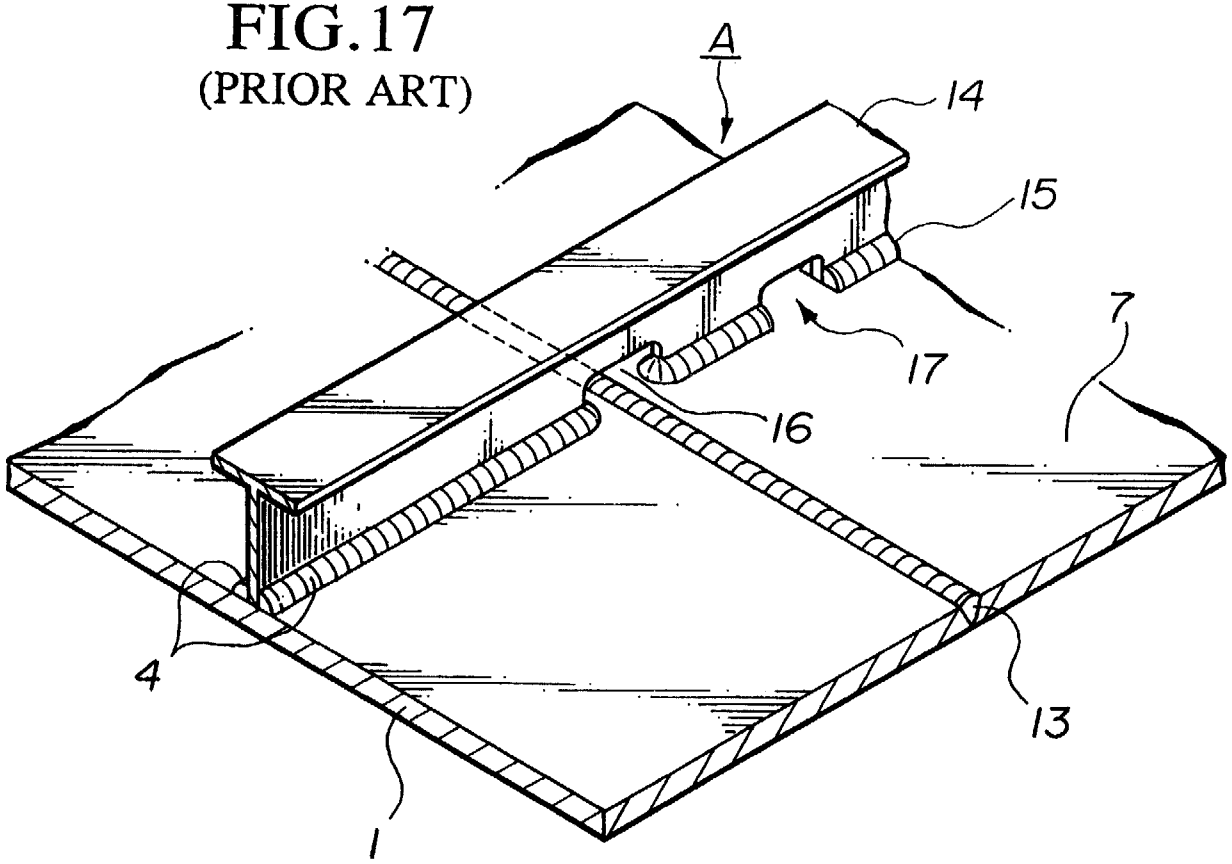
FIG. 17 (PRIOR ART)
FIG. 17 is a partial perspective view of a conventional welded structure.

The reinforced structural body X shown in FIG. 9 corresponds to, and is an improvemEant of, the reinforced structural body A shown in FIG. 17. In the reinforced structural body X, a surface of the butt weld joint 13 of the tank shell 37 is ground flush. The flush section 63 formed by the grinding treatment is defined such that the length of the area L is slightly longer than the total area in which the widths of both sides of the fillet weld portions 64 are added to that of the reinforcing member 14. The reinforcing menmber 14 is put on the surface of the tank shell 37 in such a manner that it is laid across the flush section 63, and then the corners defined by the surface of the tank shell 37 and the side surfaces of the reinforcing member 14 are welded by fillet welding to unify both of the members.

Liquid passing ports 17 are previously formed at desired positions of the reinforcing member 14 as necessary.

According to the above structure, the fillet weld portions 64 can be formed in a continuous straight line by, for example, an automatic welding machine. Therefore, there is no discontinuous section to which welding heat is applied on the transversal section of the butt weld joint 13 and the fillet weld portions 64, and this makes it possible to prevent stress concentration and defects from occurring. Furthermore, since the continuatior of the weld portions also makes it possible to simplify the structure of the weld portions, to improve the weldinq workability, and to adopt the use of an automatic welding machine, welding quality and reliability can be improved.

Figure 10:
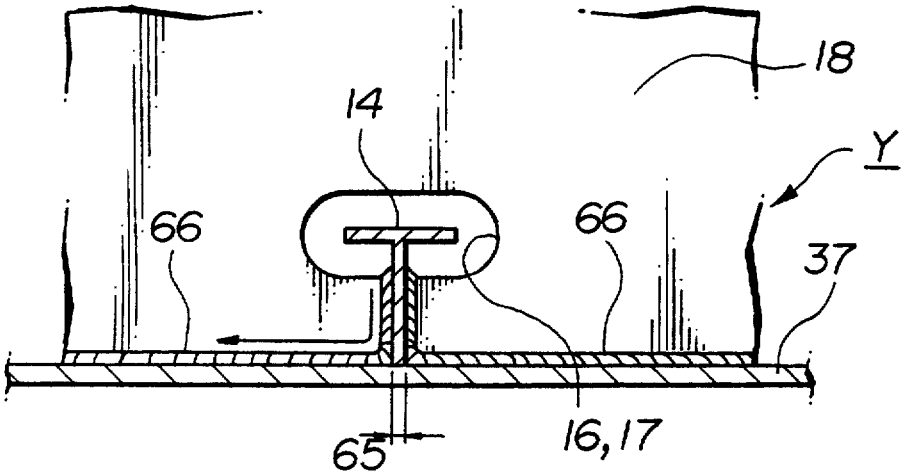
FIG. 10 is a partial elevation view of another welded structure in accordance with the present invention.
Figure 18:
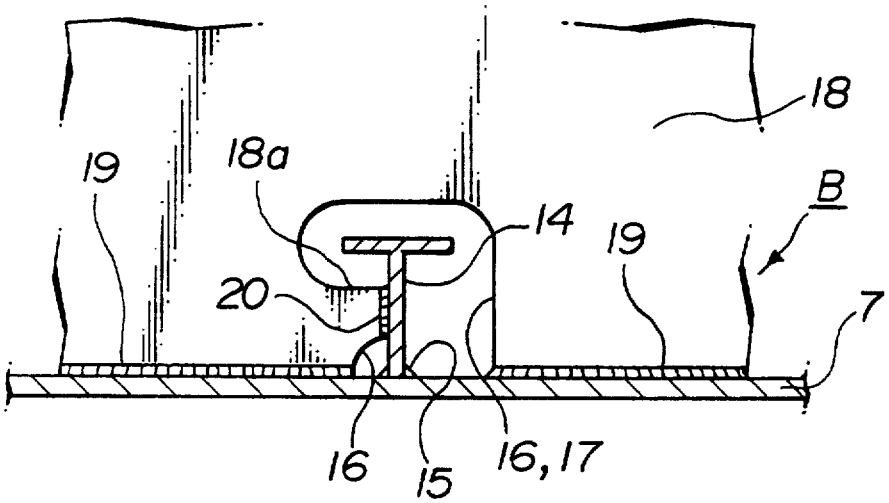
FIG. 18 (PRIOR ART)
FIG. 18 is a partial elevation view of another conventional welded structure.

The reinforced structural body Y shown in FIG. 10 corresponds to, and is an improvement of, the reinforced structural body B shown in FIG. 18. The reinforced structural body Y has the transverse reinforcing plate 18 through which the reinforcing member 14 passes. A slit 65 fhaving a diameter slightly greater than that of the member 14 and a cut-out port 16 which doubles as a liquid passing port 17 are previously formed at the portion where the member 14 passes through.

After the reinforcing menmber 14 is inserted into the slit 65 formed on the transverse reinforcing plate 18, the corners defined by the surface of the tank shell 37 and the surfaces of the transverse reinforcing plate 18, and the corners defined by both sides of the reinforcing member 14 and the surfaces of the transverse reinforcing plate 18 are welded by fillet welding to unify three of these members.

According to the above welded structure, since the fillet weld portions 66 are formed continuously by, for example, an automatic welding machine in an L-shape, the weld can be performed continuously as indicated by the arrow in FIG. 10, even if the welding direction is changed. Therefore, there is no occurrence of discontinuous application of welding heat, even at corners of the welded portion, and this makes it possible to prevent defects from occurring at points where the weld directions change, that is, at the base portion of the reinforcing member 14.

Figure 11:
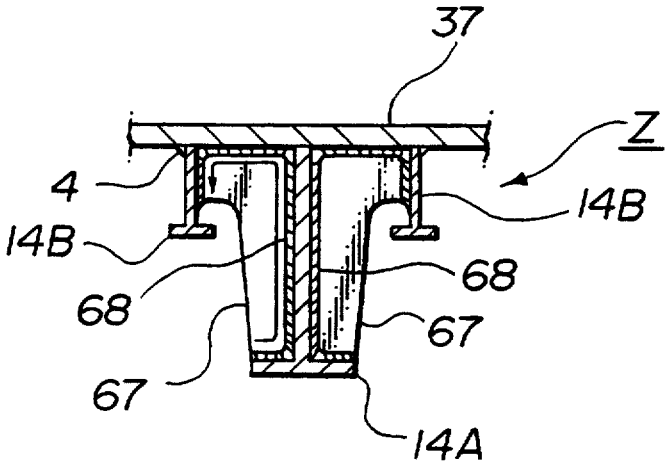
FIG. 11 is a partial elevation view of another welded structure in accordance with the present invention.
Figure 12:
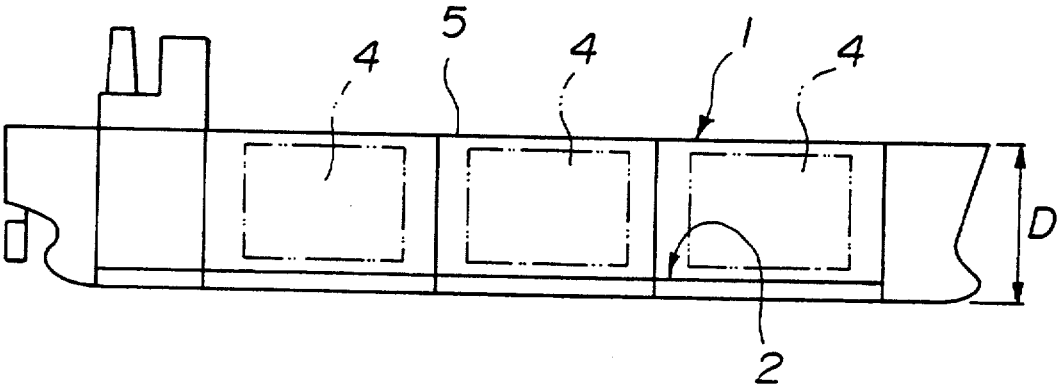
FIG.12 (PRIOR ART)
FIG. 12 is a general side view of a conventional low temperature liquified gas carrier ship having rectangular-shaped self-standing tanks
Figure 13:
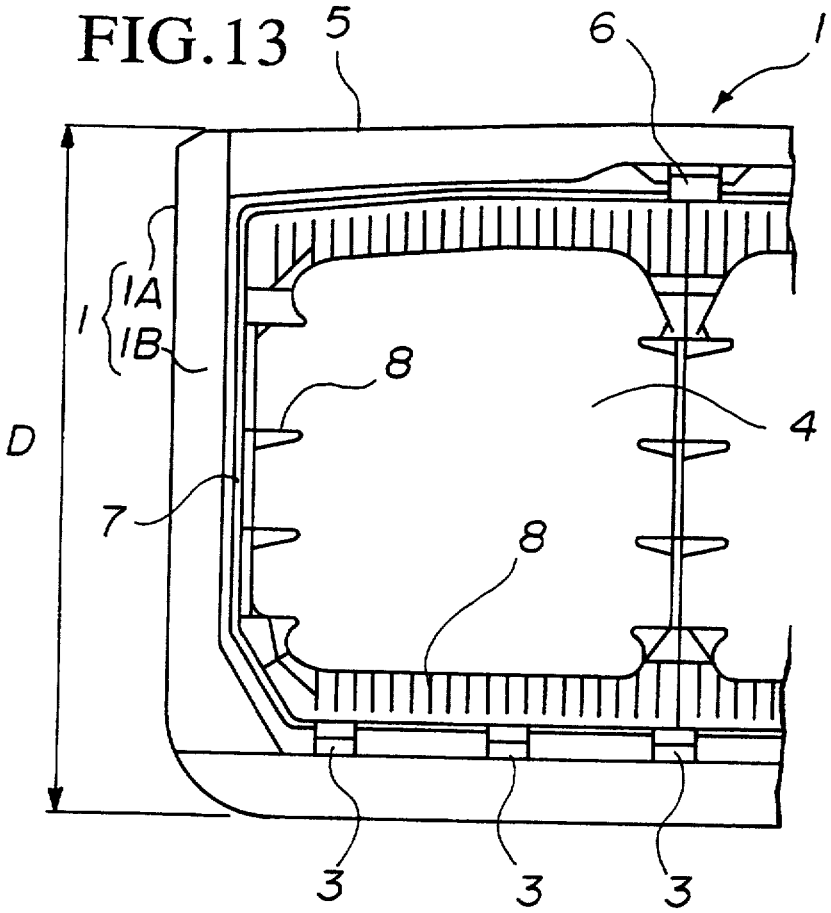
FIG. 13 is a partial sectional view of a low temperature liquified gas carrier ship having rectangular-shaped self-standing tanks.
Figure 14:
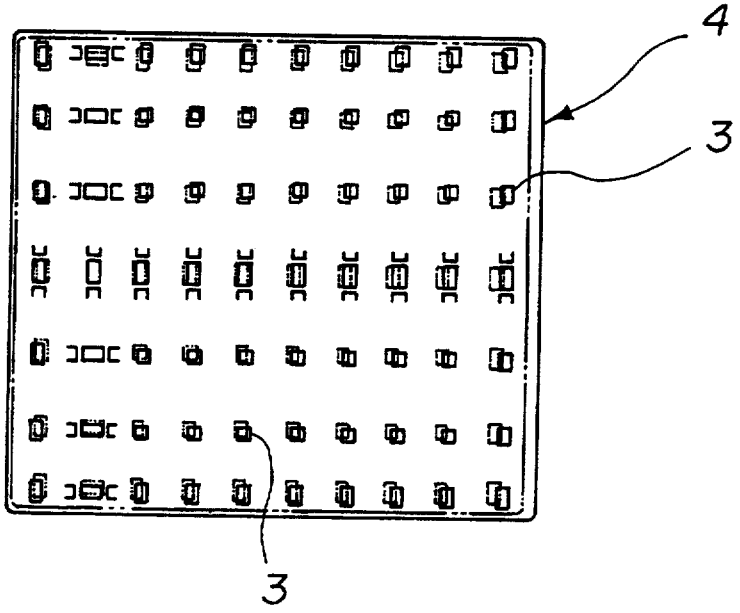
FIG. 14 is a bottom view of a rectangular-shaped self-standing tank, showing the disposition of supporting devices.
Figure 15:
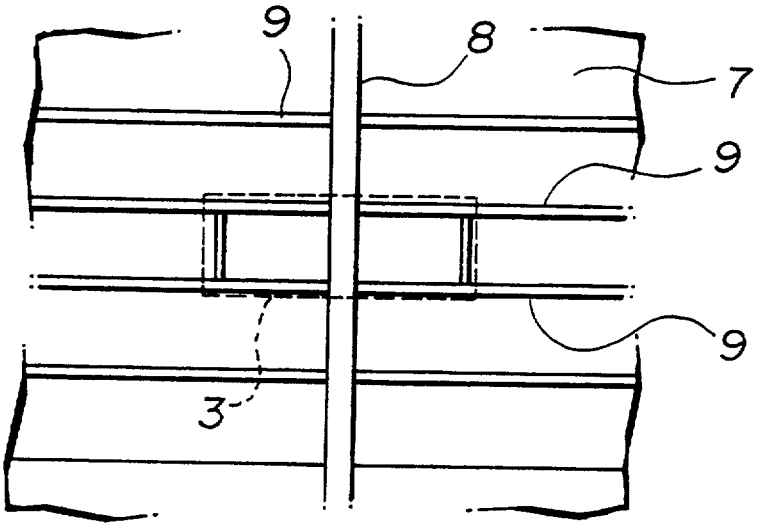
FIG. 15 is a partial plan view of a rectangular-shaped self-standing tank, showing a reinforced structure of an inner surface of the tank.
Figure 19:
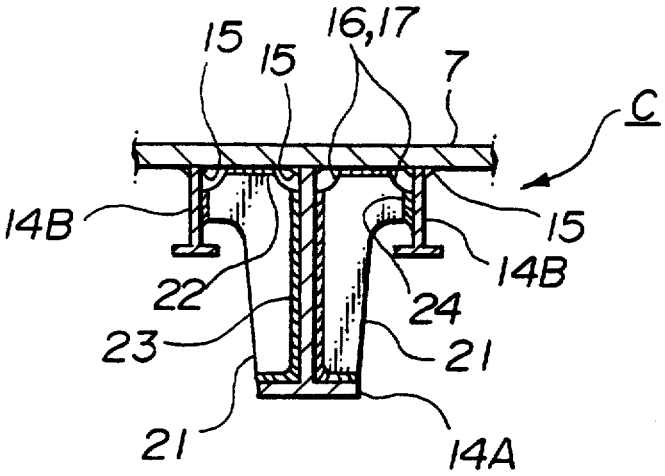
FIG. 19 (PRIOR ART)
FIG. 19 is a partial elevation view of another conventional welded structure.

The reinforced structural body Z shown in FIG. 11 corresponds to, and is an improvement of, the reinforced structural body C shown in FIG. 19. The reinforced structural body Z comprises at least one pair of reinforcing members 14A and 14B, and a rib plate 67 provided therebetween. In the structural body Z, the cut-out port 16 and the liquid passing port 17 are omitted, and the corner defined by a surface of the tank shell 37 and a surface of the rib Dlate 67, the corner defined by a side surface of the reinforcing member 14A and a surface of the rib plate 67, and the corner defined by a side surface of the reinforcing member 14B and a surface of the rib plate 67, are welded.

According to the above welded structure, even though the weld line goes in four different directions, these weld lines are not interrupted, and therefore the lines can be welded continuously as shown by an arrow in FIG. 11. Thus, according to the reinforced structural body Z, even if the direction of a weld line changes many times, a discontinuity of welding heat does not occur, and an automatic welding machine can be adopted. As a result of this, defects are prevented from occurring, and the quality and the reliability of the welds can be improved.

The aforementioned reinforced structural bodies can be adopted not only for the tank shell, but also for the shell of the ship's hull or bulkheads and the like.

What is claimed is:

1. A rectangular-shaped self-standing liquefied gas storage tank for storing low temperature liquefied gas therein, arranged in a low temperature liquefied gas carrier ship, a plurality of said tanks arranged along the longitudinal direction of the carrier ship, said low temperature liquefied gas carrier ship having a plurailty of bulkheads extending widthwise with respect to said carrier ship to define holds for housing said liquefied gas storage tanks, said self-standing liquefied gas storage tank being formed of metal sheets and comprising:

a bottom plate section having an approximately rectangular shape;

front and rear wall sections facing each other,rising approximately perpendicularly from the bottom plate section, and extending widthwise with respect to the carrier ship;

a pair of side wall sections facing each other, rising approximately perpendiculaly from the bottom plate section, and extending longitudinally along the carrier ship;

a roof plate section facing the bottom plate section;

a pair of reducing sections, each formed between said roof plate section and each of said side wall sections, and directed toward the inside of said tank as said reducing sections extend upwardly so that a sectional area of said roof plate section is smaller than that of said bottom plate section;

at least one lateral movement restraining means for preventing said liquefied gas storage tank from moving laterally, provided between said front wall section of said tank and one of said bulkheads facing said front wall section, and between said rear wall section of said tank and one of said bulkheads facing said rear wall section;

an inner surface;

reinforcing plates formed in elongated plate shape, protruding from said inner surface, and arranged parallel to one another;

reinforcing face plates, each integrated with a protruding end of each of said reinforcing plates, extending longitudinally along a longirudinal direction of said reinforcing plate, and having a width extending in the direction of the thickness of said reinforcing plate;

at least one carling, protruding from said inner surface, having a protruding end surface, provided between two of said reinforcing plates perpendicularly thereto, and at least both ends thereof being welded to two of said reinforcing plates, respectively;

wherein the height of the protrusion of said carling from said inner surface of said tank is smaller than that of said reinforcing plate, so that said protruding end surface of said carling terminates before said reinforcing face plate, and chamfers are formed at both side ends of said protruding end surface welded to said reinforcing plates respectively, said chamfers gradually lowering the height of the protrusion of said curling at both side ends of said protruding end surface.

2. A rectangular-shaped self-standing liquefied gas storage tank according to claim 1, wherein said storage tank is constructed of aluminum alloy sheets.

3. A rectangular-shaped self-standing liquefied gas storage tank according to claim 1, said carling further comprising a first surface perpendicular to both said inner surface of said tank and said reinforcing plates, and a second surface opposing said first surface through a thickness of said carling, wherein said carling is continuously welded to said reinforcing plate at least at said first surface, said second surface, and said protruding end surface, by fillet welding.

4. A rectangular-shaped self-standing liquefied gas storage tank for storing low temperature liquefied gas therein, arranged in a low temperature liquefied gas carrier ship, a plurality of said tanks arranged along the longitudinal direction of the carrier ship, said low temperature liquefied gas carrier ship having a plurality of bulkheads extending widthwise with respect to said carrier ship to define holds for housing said liquefied gas storage tanks, said self-standing liquefied gas storage tank being formed of metal sheets and comprising:

a bottom plate section having an approximately rectangular shape;

front and rear walls ections facing each other, rising approximately perpendicularly from the bottom plate section, and extending widthwise with respect to the carrier ship;

a pair of side wall sections facing each other, rising approximately perpendicularly from the bottom plate section, and extending lognitudinally along the carrier ship;

a roof plate section facing the bottom plate section;

a pair of reducing sections, each formed between said roof plate section and each of said side wall sections, and directed toward the inside of said tank as said reducing sections extend upwardly so that a sectional area of said roof plate section is smaller than that of said bottom plate section;

at least one lateral movement restraining means for preventing said liquefied gas storage tank from moving laterally, provided between said front wall section of said tank and one of said bulkheads facing said front wall section, and between said rear wall section of said tank and one of said bulkheads facing said rear wall section;

a tank shell for storing low temperature liquefied gas therein, said tank shell being constructed of metal sheets including a butt weld joint portion, and a reinforcing member having a longitudinal bar shape, welded on an inner surface of said tank shell by fillet welding so as to lie a across said butt weld joint portion of said tank shell, wherein, a surface of said butt weld joint portion to be welded to said reinforcing member defines a ground flush section which is larger than the area at which the reinforcing member is to make contact, and said reinforcing member traverses said butt weld joint portion at said flush section, and said fillet weld portions for said reinforcing member are formed continuously at a cross section of said reinforcing member and said butt weld joint portion of said tank shell.

5. A rectangular-shaped self-standing liquefied gas storage tank according to claim 4, wherein said storage tank is constructed of aluminum alloy sheets.

6. A rectangular-shaped self-standing liquefied gas storage tank for storing low temperature liquefied gas therein, arranged in a low temperature liquefied gas carrier ship, a plurality of said tanks arranged along the longitudinal direction of the carrier ship, said low temperature liquefied gas carrier ship having a plurality of bulkheads extending widthwise with respect to said carrier ship to define holds for housing said liquefied gas storage tanks, said self-standing liquefied gas storage tank being formed of metal sheets and comprising:

a bottom plate section having an approximately rectangular shape;

front and rear walls ections facing each other, rising approximately perpendicularly from the bottom plate section, and extending widthwise with respect to the carrier ship;

a pair of side wall sections facing each other, rising approximately perpendicularly from the bottom plate section, and extending lognitudinally along the carrier ship;

a roof plate section facing the bottom plate section;

a pair of reducing sections, each formed between said roof plate section and each of said side wall sections, and directed toward the inside of said tank as said reducing sections extend upwardly so that a sectional area of said roof plate section is smaller than that of said bottom plate section;

at least one lateral movement restraining means for preventing said liquefied gas storage tank from moving laterally, provided between said front wall section of said tank and one of said bulkheads facing said front wall section, and between said rear wall section of said tank and one of said bulkheads facing said rear wall section;

a tank shell for storing low temperature liquefied gas therein, said tank shell being constructed of metal sheets including a butt weld joint portion, and a reinforcing plate, welded to an inner surface of said tank shell, protruding approximately perpendicularly to the inner surface of said tank shell, a reinforcing member having a longitudinal bar plate, shape, welded on an inner surface of said tank shell so as to protrude approximately perpendicularly to the inner surface, the height of the protrusion of said reinforcing member being smaller than that of said reinforcing plate, and passing through and traversin gsaid reinforcing plate, and a slit formed on said reinforcing plate to pass throught said reinforcing member, said slit having a gap which is wider than a thickness of said reinforcing member, wherein, fillet wleds are continuously performed on each side of said reinforcing plate and each lateral surface of said reinforcing member corresponding to said slit, and on each side of said reinforcing plate and the inner surface of said tank shell.

7. A rectangular-shaped self-standing liquefied gas storage tank according to claim 6, wherein said storage tank is constructed of aluminum alloy sheets.

8. A rectangular-shaped self-standing liquefied gas storage tank for storing low temperature liquefied gas therein, arranged in a low temperature liquefied gas carrier ship, a plurality of said tanks arranged along the longitudinal direction of the carrier ship, said low temperature liquefied gas carrier ship having a plurality of bulkheads extending widthwise with respect to said carrier ship to define holds for housing said liquefied gas storage tanks, said self-standing liquefied gas storage tank being formed of metal sheets and comprising:

a bottom plate section having an approximately rectangular shape;

front and rear walls ections facing each other, rising approximately perpendicularly from the bottom plate section, and extending widthwise with respect to the carrier ship;

a pair of side wall sections facing each other, rising approximately perpendicularly from the bottom plate section, and extending lognitudinally along the carrier ship;

a roof plate section facing the bottom plate section;

a pair of reducing sections, each formed between said roof plate section and each of said side wall sections, and directed toward the inside of said tank as said reducing sections extend upwardly so that a sectional area of said roof plate section is smaller than that of said bottom plate section;

at least one lateral movement restraining means for preventing said liquefied gas storage tank from moving laterally, provided between said front wall section of said tank and one of said bulkheads facing said front wall section, and between said rear wall section of said tank and one of said bulkheads facing said rear wall section;

a tank shell for storing low temperature liquefied gas therein, a reinforcing members each having a longitudinal bar plate shape, welded on an inner surface of said tank shell so as to protrude approximately perpendicular to the inner surface, said reinforcing members arranged parallel to one another, and rib plates provided between two of said reinforcing members facing each other so as to be perpendicularly to said reinforcing members and said inner surface of said tank shell, wherein, fillet welds are continuously perofrmed on a connecting portion of an inner surface of said tank shell and each of said rib plates, and on a connecting portion of each lateral surface of said reinforcing member and each of said rib plates.

9. A rectangular-shaped self-standing liquefied gas storage tank according to claim 8, wherein said storage tank is constructed of aluminum alloy sheets.

10. A rectangular-shaped self-standing liquefied gas storage tank for storing low temperature liquefied gas therein, arranged in a low temperature liquefied gas carrier ship, a plurality of said tanks arranged along the longitudinal direction of the carrier ship, said low temperature liquefied gas carrier ship having a plurality of bulkheads extending widthwise with respect to said carrier ship to define holds for housing said liquefied gas storage tanks, said liquefied gas carrier ship comprising:

a shell;

holds, each formed in said shell to accommodate each of said rectangular-shaped self-standing liquefied gas storage tanks; and decks provided on said shell;

wherein, said shell is formed of shallow construction in which an upper end of said shell terminates before said reducing section of said tank and said decks being formed so as to cover each of said holds respectively;

said self-standing liquefied gas storage tank comprising:

a bottom plate section having an approximately rectangular shape;

front and rear wall sections facing each other, rising approximately perpendicularly from the bottom plate section, and extending widthwise with respect to the carrier ship;

a pair of side wall sections facing each other, risign approximately perpendicularly from the bottom plate section, and extending longitudinally along the carrier ship;

a roof plate section facing the bottom plate section;

a pair of reducing sections, each formed between said roof plate section and each of said side wall sections, and directed toward the inside of said tank as said reducing sections extend upwardly so that a sectional area of said roof plate section is smaller than that of said bottom plate section; and at least one lateral movement restraining means for preventing said liquefied gas storage tank from moving laterally, provided between said front wall section of said tank andone of said bulkheads facing said front wall section, and between said rear wall section of said tank and one of said bulkheads facing said rear wall section.

11. A liquefied gas carrier ship according to claim 10 wherein said rectangular-shaped self-standing liquefied gas storage tanks are constructed of aluminum alloy sheets.

* * * * *

UNITED STATES PATENT AND TRADEMARK OFFICE

CERTIFICATE OF CORRECTION

PATENT NO. : 5,375,547

DATED : December 27, 1994

INVENTOR(S) : Abe et al.

It is certified that error appears in the above-identified patent and that said Letters Patent is hereby corrected as shown below:

Column 1, line 20, delete "Aplication" and insert --Application--;
line 23, delete "be";
line 26, delete "shades" and insert --shapes--;
line 32, delete "rectangular-shaDed" and insert --rectangular-shaped--; and
line 60, delete "n%ain" and insert --main--.

Column 2, line 15, delete "if" and insert --If--;
line 28, delete "iquid" and insert --liquid--;
line 28, delete "structuze" and insert --structure--;
line 41, delete "meraber" and insert --member--;
line 43, delete "li,zruid" and insert --liquid--;
line 51, delete "1St" and insert --18--;
line 58, delete "mort" and insert --port--; and
line 61, delete "B" and insert --C--.

Column 3, line 13, delete "an.d" and insert --and--.

Column 4, line 26, delete "pornion" and insert --portion--;
line 40, delete "larier" and insert --larger--; and
line 49, delete "menlber" and insert --member--.

Column 5, line 42, delete "tructure" and insert --structure--;

UNITED STATES PATENT AND TRADEMARK OFFICE

CERTIFICATE OF CORRECTION

PATENT NO. : 5,375,547

DATED : December 27, 1994

INVENTOR(S) : Abe et al.

It is certified that error appears in the above-identified patent and that said Letters Patent is hereby corrected as shown below:

Column 5, line 53, delete "eDodiment" and insert --embodiment--;
line 57, delete "tem]Derature" and insert --temperature--; and
line 65, delete "from-the" and insert --from the--.

Column 6, line 3, delete "place" and insert --plate--;
line 9, delete "zank" and insert --tank--;
line 27, delete "men,hers" and insert --members--;
line 27, delete "insulting" and insert --insulating--; and
line 64, delete "sFip" and insert --ship--.

Column 7, line 6, delete "across;" and insert --across--;
line 13, delete "selfstanding" and insert --self-standing--; and
line 58, delete "recmangular" and insert --rectangular--.

Column 8, line 54, delete "ormed" and insert --formed--;
line 54, delete "carlinq" and insert --carling--; and
line 66, delete "tylDes" and insert --types--.

Column 9, line 8, delete "improvemEant" and insert --improvement--;
line 16, delete "menmber" and insert --member--;

UNITED STATES PATENT AND TRADEMARK OFFICE

CERTIFICATE OF CORRECTION

PATENT NO. : 5,375,547

DATED : December 27, 1994

INVENTOR(S) : Abe et al.

It is certified that error appears in the above-identified patent and that said Letters Patent is hereby corrected as shown below:

Column 9, line 33, delete "continuatior" and insert --continuation--;
line 35, delete "weldinq" and insert --welding--;
line 43, delete "fhaving" and insert --having--; and
line 48, delete "menmber" and insert --member--.

Column 10, line 7, delete "slate" and insert --plate--;
line 33, delete "plurailty" and insert --plurality--;
line 45, delete "perpendiculaly" and insert --perpendicularly--; and
line 68, delete "longirudinal" and insert --longitudinal--.

Column 11, line 18, delete "curling" and insert --carling--;
line 45, delete "walls ections" and insert --wall sections--; and
line 51, delete "lognitudinally" and insert --longitudinally--.

Column 12, line 6, after "lie" delete "a";
line 34, delete "walls ections" and insert --wall sections--;
line 40, delete "lognitudinally" and insert --longitudinally--; and
line 63, "plate," and insert --plate--.

UNITED STATES PATENT AND TRADEMARK OFFICE

CERTIFICATE OF CORRECTION

PATENT NO. : 5,375,547

DATED : December 27, 1994

INVENTOR(S) : Abe et al.

It is certified that error appears in the above-identified patent and that said Letters Patent is hereby corrected as shown below:

Column 13, line 2, delete "traversin gsaid" and insert --traversing said--;
line 4, delete "throught" and insert --through--;
line 7, delete "wleds" and insert --welds--;
line 28, delete "walls ections" and insert --wall sections--;
line 34, delete "lognitudinally" and insert --longitudinally--; and
line 52, delete "a" (first occurrence).

Column 14, line 1, delete "perofrmed" and insert --performed--;
line 38, delete "resign" and insert --rising--;
line 53, delete "andone" and insert --and one--; and
line 58, delete "10" and insert --10,--.

Signed and Sealed this

Sixteenth Day of May, 1995

*Attest:*

Bruce Lehman

BRUCE LEHMAN

*Attesting Officer*

*Commissioner of Patents and Trademarks*